US010265240B2

(12) United States Patent
Veaux

(10) Patent No.: US 10,265,240 B2
(45) Date of Patent: Apr. 23, 2019

(54) DEVICE, APPARATUS AND METHOD FOR SIMULATION OF THE PRESENCE OF A PENIS

(71) Applicant: Tacit Pleasures Inc., Vancouver (CA)

(72) Inventor: Franklin William Veaux, Portland, OR (US)

( * ) Notice: Subject to any disclaimer, the term of this patent is extended or adjusted under 35 U.S.C. 154(b) by 424 days.

(21) Appl. No.: 15/063,448

(22) Filed: Mar. 7, 2016

(65) Prior Publication Data

US 2017/0252265 A1 Sep. 7, 2017

(51) Int. Cl.

| | |
|---|---|
| ***A61H 19/00*** | (2006.01) |
| ***A61H 23/00*** | (2006.01) |
| ***A61H 23/02*** | (2006.01) |
| *A61H 39/00* | (2006.01) |

(52) U.S. Cl.

CPC ..... *A61H 19/44* (2013.01); *A61H 19/34* (2013.01); *A61H 19/40* (2013.01); *A61H 23/00* (2013.01); *A61H 23/02* (2013.01); *A61H 39/002* (2013.01); *A61H 2201/0119* (2013.01); *A61H 2201/02* (2013.01); *A61H 2201/0285* (2013.01); *A61H 2201/1628* (2013.01); *A61H 2201/1652* (2013.01); *A61H 2201/501* (2013.01); *A61H 2201/5012* (2013.01); *A61H 2201/5028* (2013.01); *A61H 2201/5058* (2013.01); *A61H 2201/5061* (2013.01); *A61H 2201/5071* (2013.01); *A61H 2201/5084* (2013.01); *A61H 2201/5097* (2013.01); *A61H 2205/085* (2013.01); *A61H 2205/087* (2013.01); *A61H 2230/50* (2013.01); *A61H 2230/505* (2013.01)

(58) Field of Classification Search

CPC ..... A61F 2/26; A61H 19/00; A61H 19/32; A61H 19/34; A61H 19/40; A61H 19/44

USPC ..... 600/38–41

See application file for complete search history.

(56) References Cited

U.S. PATENT DOCUMENTS

| | | | | |
|---|---|---|---|---|
| 4,989,592 | A * | 2/1991 | Chang | A61F 5/41 600/38 |
| 5,690,603 | A | 11/1997 | Kain | |
| 6,368,268 | B1 | 4/2002 | Sandvick et al. | |
| 6,430,450 | B1 | 8/2002 | Bach-y-Rita et al. | |
| 6,930,590 | B2 | 8/2005 | Ling et al. | |
| 7,931,605 | B2 | 4/2011 | Murison | |
| 8,360,956 | B2 | 1/2013 | Squicciarini | |
| 8,550,983 | B2 | 10/2013 | Shim | |
| 2009/0171144 | A1* | 7/2009 | Squicciarini | A61F 2/26 600/38 |
| 2010/0174135 | A1 | 7/2010 | Shim | |
| 2011/0218395 | A1 | 9/2011 | Stout | |
| 2013/0053630 | A1 | 2/2013 | Wail et al. | |
| 2014/0236151 | A1 | 8/2014 | Lee | |

* cited by examiner

*Primary Examiner* — Samuel G Gilbert

(57) ABSTRACT

A prosthetic penis provides the wearer with somatosensory feedback on another part of the wearer in response to external influences or stimuli on the prosthetic penis. Sensors on the prosthetic penis are mapped to output elements on an output device that is in contact with the wearer's body. The output device may be applied to the wearer's skin or inserted anally or vaginally. Feedback of touch, pressure, and/or temperature on the prosthesis is such that the wearer's perception mimics that of touch, pressure, and/or temperature stimuli on an actual, biological penis.

30 Claims, 5 Drawing Sheets

DEVICE, APPARATUS AND METHOD FOR SIMULATION OF THE PRESENCE OF A PENIS

TECHNICAL FIELD

This application relates to prosthetic devices and their use. In particular, this application relates to a prosthetic penis that provides the user with somatosensory feedback in response to external influences on the prosthetic penis, thereby simulating presence of a biological penis.

BACKGROUND

There are many people who are born without a physical penis who nevertheless wish to have the experience of having been born with a penis. For example, people who are assigned the female gender at birth but who consider themselves to be male (trans men), and some women who enjoy sexual intercourse with their partners wearing a prosthetic penis-like device, find a more complete sensory simulation of the experience of having a penis desirable. There are also men who have lost sensation in their penis, for example by spinal injury or other cause, and men who have lost their penis in an accident, who wish to be able to re-create an approximation of the lost sensation.

U.S. Pat. No. 5,690,603 to Kain discloses a self-retaining erogenic simulator that provides simultaneous stimulation to both users thereof. It is configured with a phallic end which is used in the normal manner and a bulbous end which is inserted within the vaginal or anal cavity of the wearing partner.

U.S. Patent Application Publication No. 2011/0218395 to Stout discloses a vibrator sex toy with an internal end and an external end. The internal end, for female genitalia, includes electric vibrator motors. The external, phallic end includes ergonomically placed touch sensors that behave like variable resistors. The touch sensors respond to natural human gestures such as grasping, stretching, compressing and bending the external end with changes in resistance. The touch sensors are connected to a control circuit by wires and act as potentiometers in the control path of the vibrator motors. The user is able to vary the sensations produced by the motors by manipulating the external end or applying it to a partner.

U.S. Patent Application Publication No. 2014/0236151 to Lee discloses a vibratory massaging device having a plurality of proximity sensors on a surface of the device, and a control circuit for controlling vibratory intensities in response to activation of the sensors. The device can be configured as a dildo, including both main and secondary vibrators, the secondary vibrator being within an arm portion that is configured for clitoral stimulation. At least one of the vibrators is automatically driven at increased intensity as penetration increases.

U.S. Pat. No. 6,930,590 to Ling et al. discloses an electrotactile system and method for delivering tactile stimuli to a skin surface of a user. The system includes one or more electrotactile modules each comprising an array of electrodes electrically connected to an integrated circuit. Each integrated circuit has data processing and current driving capability. The current delivered from the integrated circuit to each electrode is relatively small, preferably less than 4 milliamps. The modules may be connected to a flexible PC board by spring-loaded connectors. In one embodiment a plurality of electrotactile modules may be grouped together to from an electrotactile device. Multiple electrotactile devices may in turn be deployed as part of a wearable article for use in virtual reality, telepresence, telerobotics or other haptic feedback applications. The system is capable receiving and transmitting tactile data via a communication link, such as a conventional data network. For example, tactile data can be transmitted in a scalable streaming format from a remote site to the system via a data network. The system may form part of a virtual reality entertainment application.

This background information is provided to reveal information believed by the applicant to be of possible relevance to the present invention. No admission is necessarily intended, nor should be construed, that any of the preceding information constitutes prior art against the present invention.

SUMMARY OF INVENTION

This invention is a method, device and apparatus for simulating the presence of a penis. A prosthetic penis provides the wearer with somatosensory feedback in response to external influences on the prosthetic penis. Sensors on the prosthetic penis are spatially mapped to output elements on an output device that is in contact with the wearer's body. The output device may be applied to the wearer's skin or, in another configuration, inserted anally or vaginally.

The invention takes advantage of the fact that the human brain exhibits remarkable plasticity in adapting somatosensory perception to accommodate novel sensory inputs. The invention provides feedback from a prosthetic penis subjected to touch, pressure, and/or temperature in such a way that the user's perception tracks or mimics that of touch, pressure, and/or temperature stimuli on an actual, biological penis. The user's somatosensory perception can incorporate this feedback to such a degree that the invention becomes, perceptually, an extension of the user's body.

Disclosed herein is a prosthetic penile device, comprising: a penis-shaped component to be worn by a wearer; and multiple sensors located on or in the penis-shaped component and configured to detect stimuli on the penis-shaped component; wherein: each sensor is mapped to a different output element of an output device to be placed in bodily contact with the wearer; each output element is activated in response to a stimulus detected by the sensor to which it is mapped; and each output element stimulates a different location of the wearer.

Further disclosed herein is an apparatus for simulating presence of a penis, comprising: a prosthetic penile device, comprising: a penis-shaped component to be worn by a wearer; and multiple sensors located on or in the penis-shaped component and configured to detect stimuli on the penis-shaped component; and an output device to be placed in bodily contact with the wearer, comprising multiple output elements, wherein: each sensor is mapped to a different output element of the output device; each output element is activated in response to a stimulus detected by the sensor to which it is mapped; and each output element stimulates a different location of the wearer.

As still further disclosed, another aspect of the present invention is a method for simulating presence of a penis, comprising: wearing a prosthetic penile device having a penis-shaped component and multiple sensors located on or in the penis-shaped component and configured to detect stimuli on the penis-shaped component; and wearing, in bodily contact, an output device comprising multiple output elements, wherein each sensor is mapped to a different output element of the output device; each output element is activated in response to a stimulus detected by the sensor to which it is mapped; and each output element stimulates a different location of the wearer.

The method may further comprise: sensing, by one of the sensors, a stimulus on the penis-shaped component; converting the sensed stimulus to an electrical signal; calculating, by a processor, an output signal responsive to the electrical signal; transmitting the output signal to the output element that is mapped to said one of the sensors; and activating the output element that is mapped to said one of the sensors to stimulate the wearer.

BRIEF DESCRIPTION OF DRAWINGS

The following drawings illustrate embodiments of the invention, which should not be construed as restricting the scope of the invention in any way.

DESCRIPTION

A. Glossary

Figure 1:
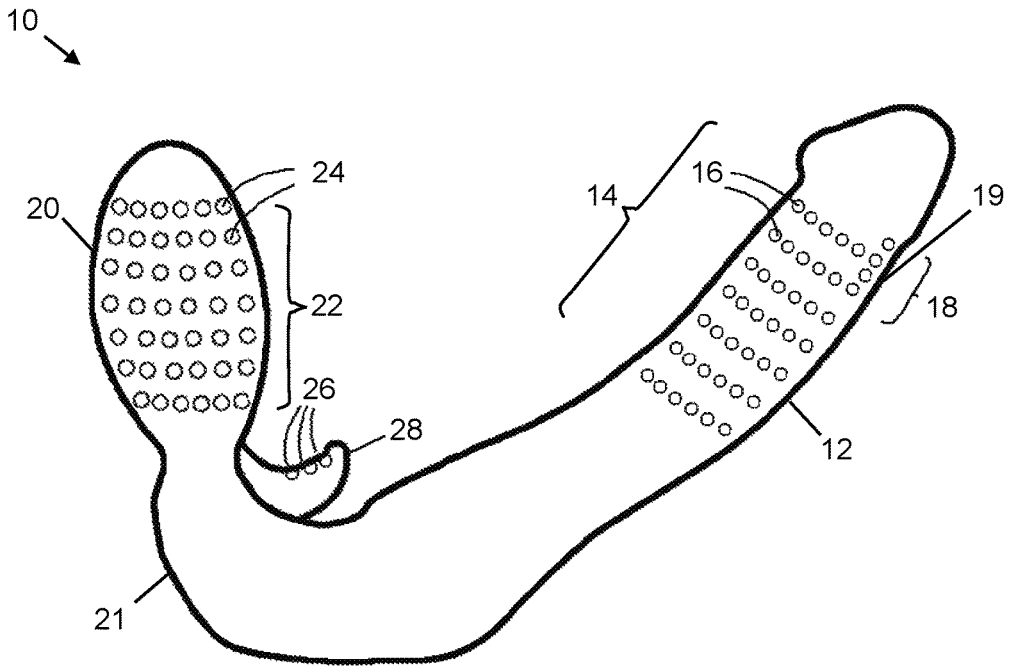
FIG. 1 is a right side elevation of a first embodiment of the present invention.

The term "firmware" includes, but is not limited to, program code and data used to control and manage the interactions between the various components of the system.

The term "hardware" includes, but is not limited to, the physical housing for a computer or processor, including a display screen if present, connectors, wiring, circuit boards having processor and memory units, power supply, sensors, motors, actuators and other electrical or electronic components or output elements.

The term "network" can include both a mobile network and data network without limiting the term's meaning, and includes the use of wireless (e.g. 2G, 3G, 4G, WiFi, WiMAX™, Wireless USB (Universal Serial Bus), Zigbee™, Bluetooth™ and satellite), and/or hard wired connections such as internet, ADSL (Asymmetrical Digital Subscriber Line), DSL (Digital Subscriber Line), cable modem, T1, T3, fibre, dial-up modem, television cable, and may include connections to flash memory data cards and/or USB memory sticks where appropriate. A network could also mean dedicated connections between computing devices and electronic or electric components.

The term "processor" is used to refer to any electronic circuit or group of circuits that perform calculations, and may include, for example, single or multicore processors, multiple processors, an ASIC (Application Specific Integrated Circuit), and dedicated circuits implemented, for example, on a reconfigurable device such as an FPGA (Field Programmable Gate Array). The processor performs the steps in the flowchart, whether they are explicitly described as being executed by the processor or whether the execution thereby is implicit due to the steps being described as performed by code, device, apparatus or a component of the invention. The processor, if comprised of multiple processors, may be located together or geographically separate from each other. The term includes virtual processors and machine instances as in cloud computing or local virtualization, which are ultimately grounded in physical processors. The processor may include or have access to electronic memory, in which is stored the computer readable instructions that are executed to enable the processor to perform its functions.

The term "somatosensory" relates to the sense of touch or tactile perception, and may include haptic perception. Phenomena that may be sensed include temperature, radiation, touch, forces, motion (e.g. vibrations) and chemicals.

The term "software" includes, but is not limited to, program code that performs the computations necessary for calculating and optimizing outputs based on user inputs and sensed inputs.

The term "user" or "wearer" refers to a person who uses the penile presence simulation apparatus or device of the present invention, e.g. by wearing it.

B. Overview

The present invention is a human-machine interface apparatus that provides high-resolution tactile feedback to its wearer based on input from sensors on a prosthetic penile device. Sensors may detect pressure, temperature or other phenomena. Each of the sensors on the penile prosthetic device is spatially mapped to an output element on an output device that is in bodily contact with the wearer.

A tactile substitute of the somatosensory perception of a penis is created by stimulation of the wearer's body, for example by stimulating sensory nerves within the vaginal wall, anus, or skin. The sensors trigger sensation to a user via electrical or other stimulation of the user's nervous system. Impulses are provided to the wearer based on data received from the sensors, so that the wearer can 'feel' the prosthetic penile device. The output elements use vibration, electrical stimulation or other means to create a localized sensation. The output device may be an insertable object containing many such output elements, which is worn inside the vagina or anus or affixed to some other part of the body.

Stimulation on the prosthetic penile device therefore creates a perceptible tactile sensation in a correspondingly mapped area of the wearer's body, such that the wearer is aware of stimulation of the prosthetic penile device.

Specifically, the apparatus of the present invention include three distinct components. The first component is a prosthetic penile device, which is equipped with multiple sensors that can respond to pressure, touch, temperature, and/or other environmental factors. The second component is a processor, which recognizes signals from the sensors and responds to these signals by activating tactile output elements, such as electrodes or vibratory devices. The processor may be a bespoke component of the apparatus, it may be incorporated in another component of the apparatus, or it may be a general-purpose computing device such as a computer or smart phone running appropriate software and with appropriate wired or wireless connections to the sensors and output elements. The third component is an array of tactile output elements, which may use vibration, electric current or other means to create a tactile sensation. The output elements are arranged on an output device, which can be inserted into the vagina or anus or worn on some other part of the body.

The input sensors on the prosthetic penile device are spatially mapped to the output elements on the output device such that stimulation on one part of the prosthetic penile device causes activation of the corresponding output element on the output device. This creates a 1:1 correspondence between the location of stimulation on the prosthetic penile device and the location of the tactile stimulation on the output device. For example, the prosthetic penile device is equipped with an array of touch-sensitive sensors, and an array of electrodes is mounted on the surface of the output device that is worn inside the vagina, such that touch on one portion of the prosthetic penile device causes a sensation by electrically stimulating a corresponding location inside the vagina.

The tactile sensation provided to the wearer may be proportional to or otherwise correspond to the intensity of touch or pressure on the prosthetic penile device, such that greater pressure on one of the sensors fitted to the prosthetic penile device produces greater stimulation at the location of the corresponding output element on of the wearer's body. Greater stimulation may be, for example, by way of greater vibration or greater electrical current produced by the output element.

The output device may also provide the wearer with additional forms of stimulation corresponding to other types of stimulation of the prosthetic penile device, such as temperature. In this case, the prosthetic penile device can be equipped with one or more thermometric sensors that measure temperature. These temperature measurements are relayed to the processor, which in turn may change the temperature of some of the output elements on the output device, for example using Peltier devices or other means known to the art.

The human body is not uniformly sensitive everywhere, because some parts of the body have a greater neural density, and therefore a greater sensitivity to tactile stimulation, than others. This difference in sensitivity in different parts of the body can be mimicked by placing a greater number or density of sensors on parts of the prosthetic penile device that correspond to areas of greatest sensitivity of a biological penis. The sensors of greatest density on the prosthetic penile device can be mapped to corresponding output elements that stimulate parts of the female body with greatest tactile sensitivity, such as the clitoris.

The processor may recognize signals from the sensors on the prosthetic penile device through wires passing from the sensors to the processor, or wirelessly through analog or digital radio signals. Similarly, the processor may pass activation signals to the output elements through wires or wirelessly via analog or digital radio signals.

C. Exemplary Embodiments

Referring to FIG. 1, a first embodiment of a prosthetic penile device 10 is shown that is fabricated from a flexible material, such as silicone. In this embodiment, the device 10 is a single unit. The prosthetic penile device 10 consists of an external, penis-shaped portion 12, which is worn outside of the wearer's body. This external portion 12 of the device 10 is fitted with an array 14 of sensors 16, which respond to physical pressure, touch, and/or temperature by producing an electrical signal or a change in an electrical property, for example. These sensors 16 may be on the surface of the external portion 12 of the prosthetic penile device 10, just beneath its surface, or fabricated on a flexible substrate, which is wrapped around the external portion of the prosthetic penile device. The array 14 of sensors 16 includes a denser portion 18 on the underside, forwardmost portion 19 of the external portion 12 of the prosthetic penile device 10, corresponding to the area of maximum neural density and tactile sensitivity of a biological penis.

This prosthetic penile device 10 also has a bulb-shaped, internal portion 20 on its rearward terminal end, which is intended to be inserted in a lower body cavity of the wearer, i.e. in the wearer's vagina or anus. The bulb 20 is connected at angle to the external portion 12 via a flexible neck 21, the bulb, neck and external portion forming a unitary structure. The bulb 20 is an output component of the prosthetic penile device 10, and has an array 22 of output elements 24, which correspond to and are spatially mapped to the tactile sensors 16 on the external portion 12 of the prosthetic penile device. The array may or may not be uniform. In embodiments that are used vaginally, the bulb also has additional output elements 26 located on a projection 28, which is intended to rest against the wearer's clitoris. The additional output elements 26 are mapped to the tactile sensors in the denser portion 18 of the array 14 on the external portion 12 of the prosthetic penile device 10, so as to stimulate the wearer's clitoris as and when the denser tactile sensors are stimulated.

In an embodiment intended for anal insertion, the projection 28 would be omitted and the denser tactile sensors in portion 18 of array 14 would be mapped to additional output elements 24 on the bulb 20. With or without the clitoral projection 28, the distribution of output elements 24 on the bulb 20 may be in a non-uniform array. The output elements 24 may be mapped to the uneven distribution of tactile sensors 16 on the external portion 12 in such a way that the output elements are in a greater concentration on the areas of the bulb that are in contact with areas of the wearer's body with a greater concentration of sensory nerves and/or are most sensitive to stimulation.

The array 22 of output elements 24, like the array 14 of sensors 16, may be on or beneath the surface of the bulb 20 of the prosthetic penile device, or on a flexible substrate wrapped around the bulb. The output elements 24, 26 may produce sensation in the wearer in several ways, including by vibration, by change in temperature, or by electrical current. The output elements 24, 26 respond to signals from a processor (not shown in this embodiment) within the prosthetic penile device 10 to create tactile stimulation in the wearer that corresponds to stimulation on the surface of the external portion 12 of the prosthetic penile device 10. In other embodiments, the processor may be located in a separate housing connected via wires or wirelessly via radio waves to the array 14 of sensors 16, the array 20 of output elements 24, and the additional output elements 26.

The sensors 16 on the prosthetic penile device 10 may be piezoelectric sensors, resistive sensors, temperature sensors, capacitive sensors, or sensors using other technologies known to the art. These sensors 16 may communicate with the processor by means of a change in voltage, current, or a digital signal in response to pressure, touch, temperature, or other environmental factors. The processor logic recognizes and responds to the signals provided by the sensors 16 by triggering related signals to the corresponding output element 24, 26, so as to create a sensation in the wearer that corresponds to the signals from the sensors. The signals may communicate information such as touch, pressure, and temperature to the wearer, whereby a stronger signal from a tactile sensor 16 corresponds to greater pressure on the sensor and results in a greater signal to the corresponding output element 24, 26. The signals sent to the output elements 24, 26 may be in the form of a digital signal, an analog voltage, or a pulse code modulated signal, for example. Signals sent to the output elements 24, 26 may correspond to a level of vibration to be imparted by the output elements. Greater pressure on a tactile sensor or higher temperature on a temperature sensor produces correspondingly greater stimulation of the wearer at the corresponding output element.

This embodiment may also include a harness or strap designed to hold the device 10 securely in place. The processor may be incorporated into the device 10, or may be in a separate housing which communicates with the sensors 16 and output elements 24, 26 of the device via wires or wirelessly through analog or digital radio signals. The processor may be equipped with a user interface permitting the wearer to adjust the maximum level of stimulation provided by the output elements, the processor being configured to scale the calculated values representing the degree of stimulation to be provided to the wearer accordingly.

Figure 2:
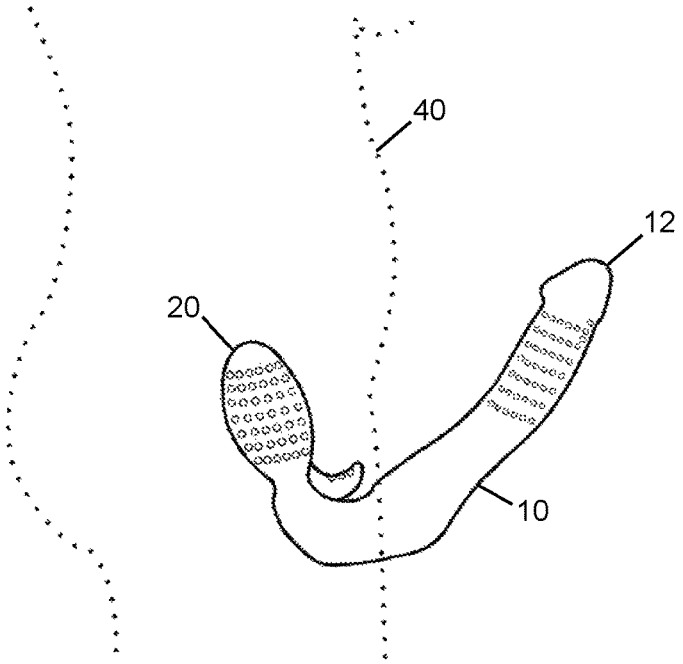
FIG. 2 is a phantom side elevation of a user showing how the first embodiment of the invention is worn.

FIG. 2 shows the use of the embodiment of FIG. 1. The dotted outline shows the figure of a person 40 born with a vagina wearing the prosthetic penile device 10, in such a way that the bulb 20 on the base of the device is inside the wearer's vagina, and the external portion 12 extends forwards from the wearer's body in a manner similar to that of a biological penis.

Figure 3:
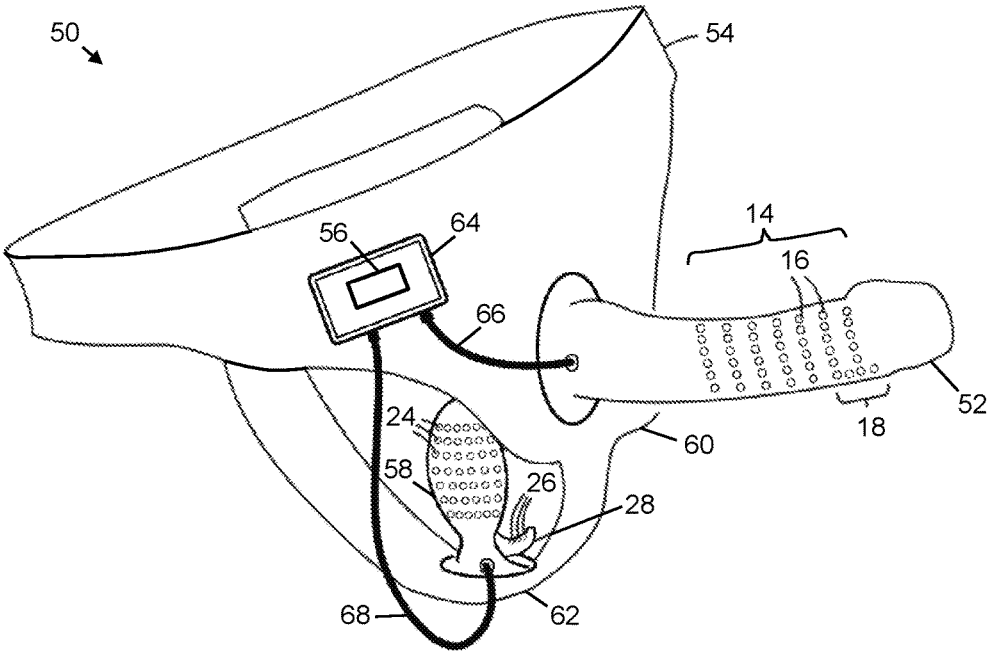
FIG. 3 is a three-quarters view of a second embodiment of the present invention.

FIG. 3 illustrates a second embodiment of the present invention, in the form of an apparatus 50 for the simulation of the presence of a penis. The apparatus 50 includes a prosthetic penile device 52, a harness 54, a processor 56 and an output device 58, which are not necessarily all part of the same mechanical structure. The prosthetic penile device 52 is mounted to the front 60 of the harness 54, which is worn around the wearer's hips to hold it firmly in place. The output device 58 is a vaginal or anal bulb that is separate from the prosthetic penile device 52, and is mounted at the base 62 of the harness 54, such that the harness holds it within the vagina or anus of the wearer during use. In this embodiment, the processor 56 is mounted inside a processor housing 64, which is mounted to the harness 54.

The array 14 of tactile sensors 16 including the area 18 of greater sensor density on the prosthetic penile device 52 are as described above with respect to FIG. 1. Also, as above, for embodiments where the bulbous output device 58 is to be used vaginally, the bulb is lined with an array of output elements 24 designed to produce tactile sensation inside the wearer's vagina, as well as including a protrusion 28 which contains additional output elements 26 positioned to stimulate the wearer's clitoris. Again, in an embodiment intended for anal insertion, the clitoral projection 28 would be omitted and the additional output elements would be replaced with further output elements 24 on the main body of the bulbous output device 58. The output elements 26 are mapped to the area 18 of higher density of tactile sensors 16 on the prosthetic penile device 52.

The processor housing 64 contains the electronics, software and/or firmware and power supply necessary to operate the apparatus 50, and is electrically connected to the prosthetic penile device 52 by wires 66, and to the output device 58 by wires 68. An alternative to this embodiment includes locating the processor 56 within the prosthetic penile device 52. Another alternative includes locating the processor in a housing separate from the harness 54 and communicatively connected to the prosthetic penile device 52 and the output device 58 by radio waves rather than wires. The radio waves may be transmitted by any bespoke, local or other network.

Figure 4:
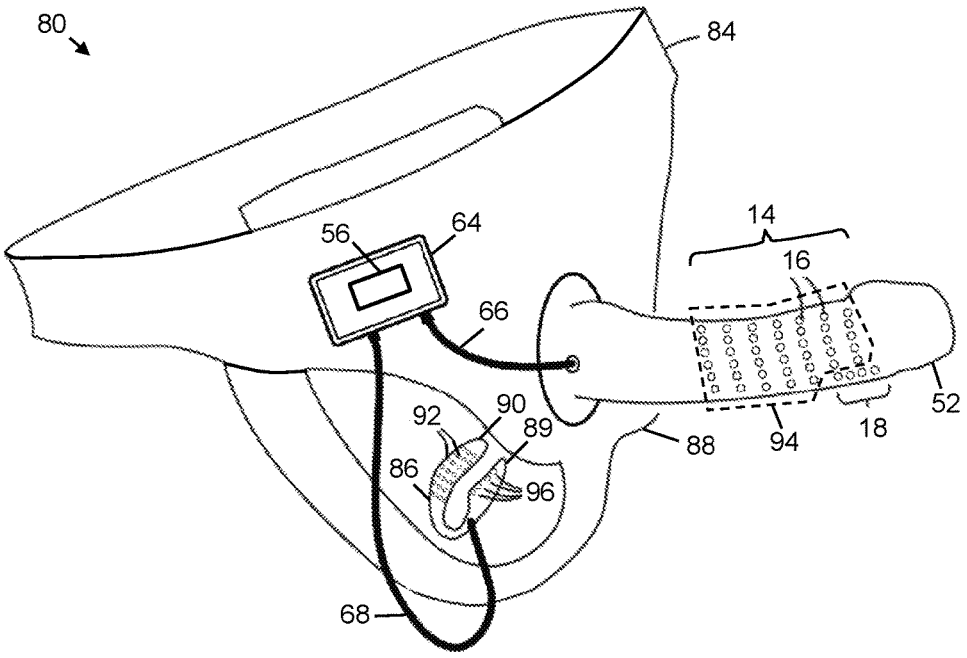
FIG. 4 is a three-quarters view of a third embodiment of the present invention.

FIG. 4 illustrates a third embodiment of the present invention, in the form of an apparatus 80 for the simulation of the presence of a penis. The apparatus 80 includes a prosthetic penile device 52, a harness 84, a processor 56 and an output device 86. The prosthetic penile device 52 is mounted to the front 88 of the harness 84, which is worn around the wearer's hips to hold it firmly in place. The array 14 of tactile sensors 16 including the area 18 of greater sensor density on the prosthetic penile device 52 are as described above.

The output device 86 is a vaginal insert with clitoral wraparound 89, and is designed to be inserted into the wearer's vagina and to wrap around the wearer's clitoris. The insertable portion 90 of the output device 86 is lined with an array of output elements 92 which are mapped to the sensors 94 on the shaft of the prosthetic penile device 52, and an array of output elements 96 on wraparound 89 which are mapped to the sensors in area 18 of the prosthetic penile device corresponding to areas of maximum sensitivity on a biological penis. As in the other embodiments, a processor housing or unit 64 containing the processor 56 is mounted to the harness 84, but other configurations for the arrangement of processor, prosthetic penile device 52, and output device 86 may be used. The processor housing 64 contains the electronics, software, firmware and power supply necessary to operate the apparatus 80, and is electrically connected to the prosthetic penile device 52 by wires 66, and to the output device 86 by wires 68. An alternative to this embodiment includes locating the processor 56 within the prosthetic penile device 52. Another alternative includes locating the processor in a housing separate from the harness 84 and communicatively connected to the prosthetic penile device 52 and the output device 86 by radio waves rather than wires.

Figure 5:
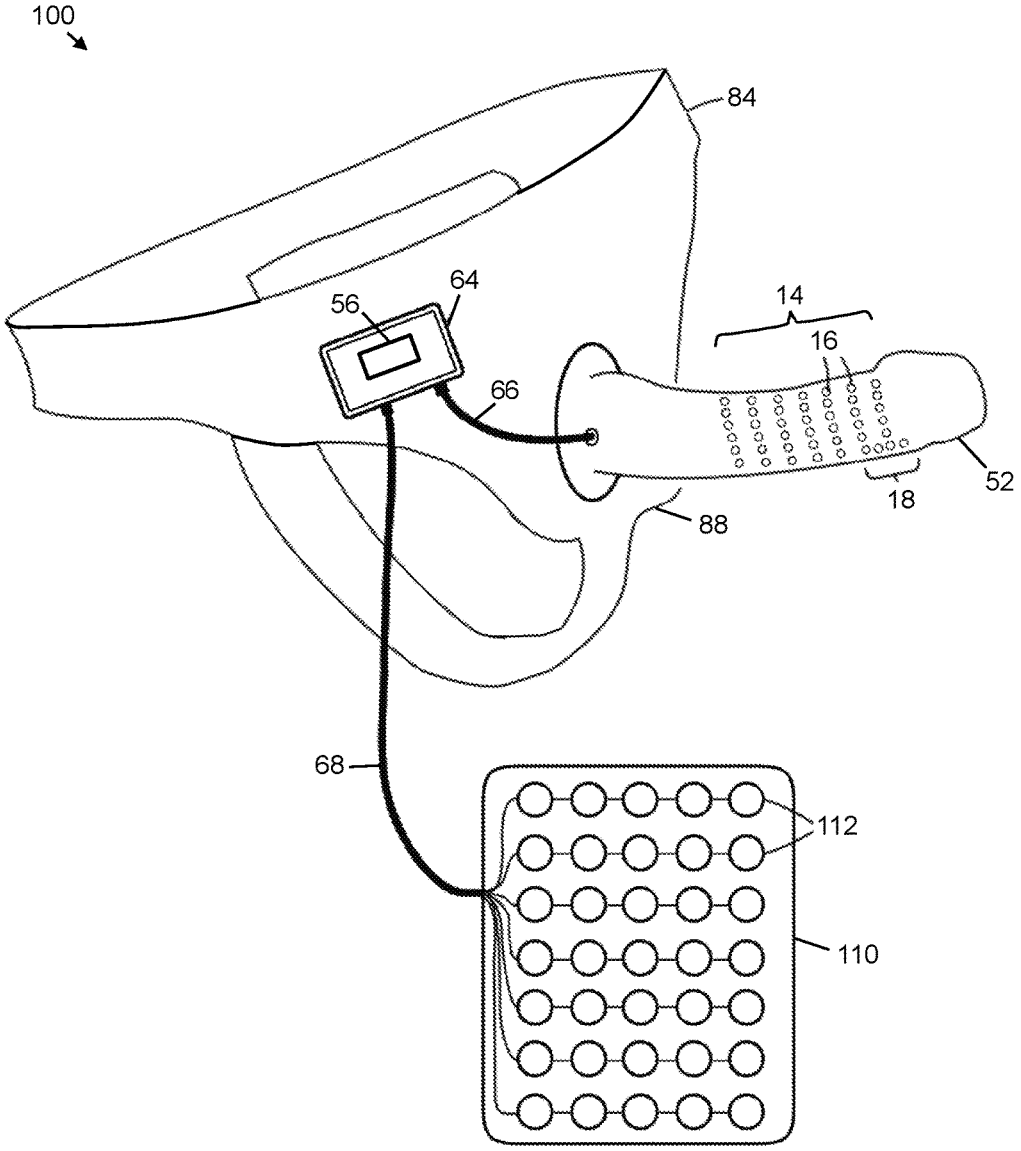
FIG. 5 is a three-quarters view of the harness and a schematic plan of an external output device, according to a fourth embodiment of the present invention.

FIG. 5 shows a fourth embodiment of the invention, of an apparatus 100 for the simulation of the presence of a penis. The apparatus 100 includes a prosthetic penile device 52, a harness 84, a processor 56 and an external output device 110. The prosthetic penile device 52 is mounted to the front 88 of the harness 84, which is worn around the wearer's hips to hold it firmly in place. The array 14 of tactile sensors 16 including the area 18 of greater sensor density on the prosthetic penile device 52 are as described above.

Apparatus 100 makes use of output elements 112 that stimulate the wearer through the skin rather than via an insertable output device that stimulates the wearer internally. In this embodiment, the stimulation is provided by the output device 110, which is a pad covered with electrical (e.g. electrodes) or vibrating output elements 112 that are placed in contact with the outside of the body. The output elements 112 stimulate the wearer when the sensors 16 on the prosthetic penile device 52 are activated. The output device 110 may be affixed to the wearer's skin (e.g. on their back) via adhesive or held in place mechanically by straps, specially designed clothing, or other means. The distribution of output elements 112 on the output device 110 may be in a uniform array. Alternately, the distribution of output elements 112 on the output device 110 may be in a non-uniform array, with the output elements being mapped to the uneven distribution of tactile sensors 16 on the prosthetic penile device 52 in such a way that the output elements are in a greater concentration on the areas of the output device that are in contact with areas of the wearer's skin having a greater concentration of sensory nerves and/or that are most sensitive to stimulation.

As in the other embodiments, a processor housing 64 containing the processor 56 is mounted to the harness 84, but other configurations for the arrangement of processor, prosthetic penile device 52, and output device 110 may be used. The processor housing 64 contains the electronics and power supply necessary to operate the apparatus 100, and is electrically connected to the prosthetic penile device 52 by wires 66, and to the external output device 110 by wires 68. An alternative to this embodiment includes locating the processor 56 within the prosthetic penile device 52. Another alternative includes locating the processor in a housing separate from the harness 84 and communicatively connected to the prosthetic penile device 52 and the output device 110 by radio waves rather than wires.

Figure 6:
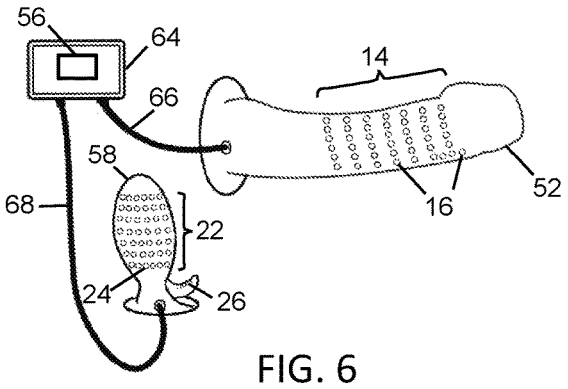
FIG. 6 is a schematic representation of an apparatus with wired connections between the prosthetic device, processor and output device, according to an embodiment of the present invention.

Referring to FIG. 6, an arrangement of the electrical communication paths between the processor 56, the prosthetic penile device 52 and the output device 58 is shown. In this arrangement, the processor 56 communicates with the array 14 of sensors 16 on the prosthetic penile device 52 by wires 66. The processor 56 communicates with the array 22 of output elements 24 and additional output elements 26 on the output device 58 via wires 68. The processor housing 64 may be mounted on a harness or may be separate from the harness.

Figure 7:
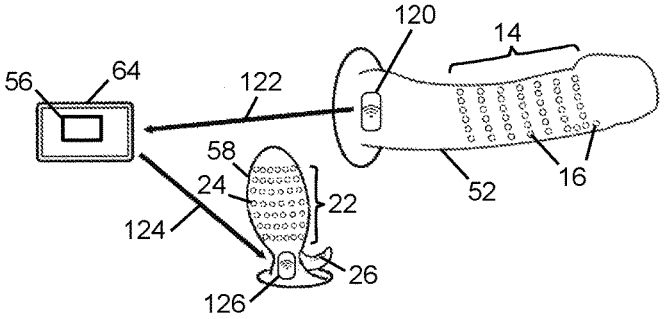
FIG. 7 is a schematic representation of an apparatus with wireless connections between the prosthetic device, processor and output device, according to an embodiment of the present invention.

Referring to FIG. 7, another arrangement of the electrical communication paths between the processor 56, the prosthetic penile device 52 and the output device 58 is shown. In this arrangement, the processor 56 receives data from the array 14 of sensors 16 on the prosthetic penile device 52 via a transmitter 120 in the prosthetic penile device, which transmits the data by wireless communication path 122. The processor 56 communicates with the array 22 of output elements 24 and the additional output elements 26 on the output device 58 via wireless communication path 124 and receiver 126 mounted in the output device. The processor housing 64 may be mounted on a harness or may be separate from the harness. The transmitter 120 and receiver 126 may use digital or analog radio signals.

Figure 8:
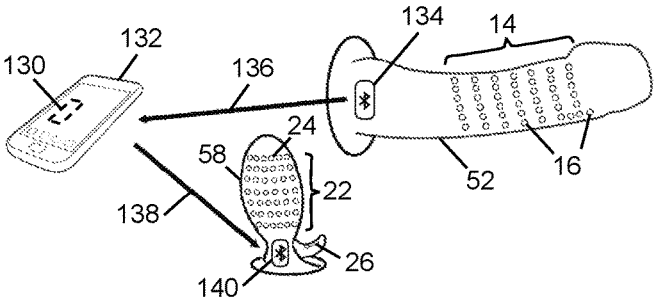
FIG. 8 is a schematic representation of an apparatus with wireless connections between the prosthetic device, a smartphone used as the processor, and the output device, according to an embodiment of the present invention.

Referring to FIG. 8, a further arrangement of the electrical communication paths between a processor 130, the prosthetic penile device 52 and the output device 58 is shown. Here, the processor component is not a dedicated hardware device, but rather a computer program being executed by a processor 130 in a smartphone 132. The processor 130 receives data from the array 14 of sensors 16 on the prosthetic penile device 52 via a Bluetooth™ transmitter 134 in the prosthetic penile device and wireless communication path 136. The processor 130 communicates with the array 22 of output elements 24 and the additional output elements 26 on the output device 58 via wireless communication path 138 and Bluetooth™ receiver 140 mounted in the output device. In other embodiments, the smartphone may be replaced with a tablet, a laptop, a desktop or any other electronic device and/or network that provides the necessary equivalent functionality, in the form of interface hardware and/or software, to fulfill the requirements of the invention.

Figure 9:
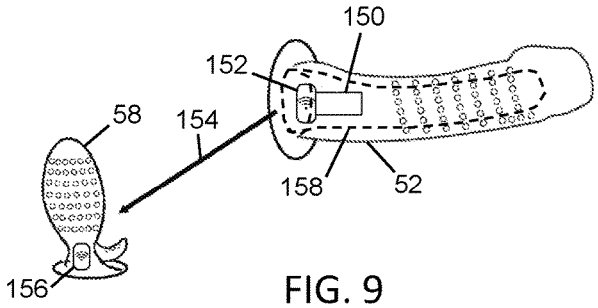
FIG. 9 is a schematic representation of an apparatus with a wireless connection between a prosthetic device, which includes the processor, and the output device, according to an embodiment of the present invention.

Referring to the embodiment in FIG. 9, the processor 150 is combined with a transmitter 152 located in the body of the prosthetic penile device 52. The processor 150 communicates with the output device 58 via wireless connection 154 and a receiver 156 located within the body of the output device. It should be recognized that many other arrangements for forming communication links between the various devices and components of the invention present themselves to those skilled in the art.

A variation on the device intended for use by men who have experienced nervous system or spinal damage or some other disability that has reduced or eliminated sensation in the penis may include a prosthetic penile device 52 that is hollow 158 and intended to be worn by means of straps or a harness over the biological penis, with the output device 58 or 110 being worn in contact with the wearer's body in a place where the wearer can still perceive sensation.

Figure 10:
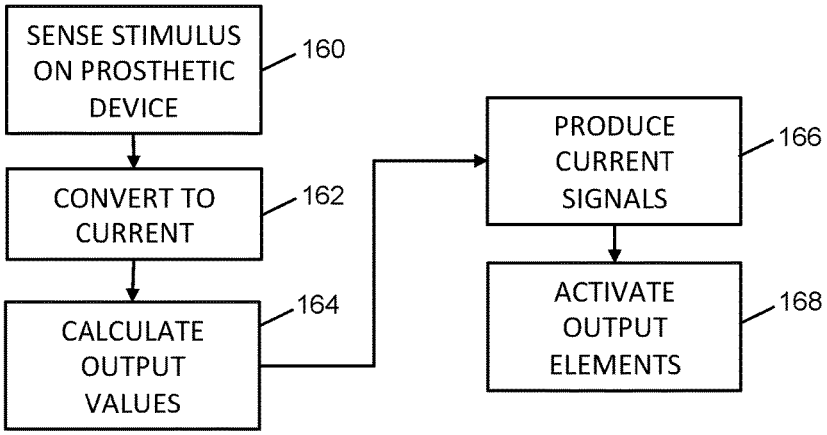
FIG. 10 is a flowchart of a method that the penile presence simulation apparatus performs, according to an embodiment of the present invention.

Referring to FIG. 10, a method for the simulation of the presence of a penis is shown, which is undertaken by the prosthetic penile device 10 and the apparatuses 50, 80, 100. Steps of the method are performed by the various components of the device or apparatus, including the sensors, the processor and the output elements. In step 160, sensors on the prosthetic penile device sense a stimulus, which may be a touch, a force, a pressure, a temperature, etc. In step 162, the sensed stimulus is converted to electrical signals, either directly by the sensors or by electronic circuitry that is connected to the sensors. In step 164, the processor analyzes the signals produced by the sensors by creating corresponding values therefor, and then calculates output values that are related to the signals.

In step 166, based on the output values, the processor produces, or causes the production of, the electrical output signals that correspond to the desired output sensation to be created in the wearer. In step 168, the output signals are transmitted to the output elements, which, as a result, are activated according to the electrical output signals produced by the processor.

Figure 11:
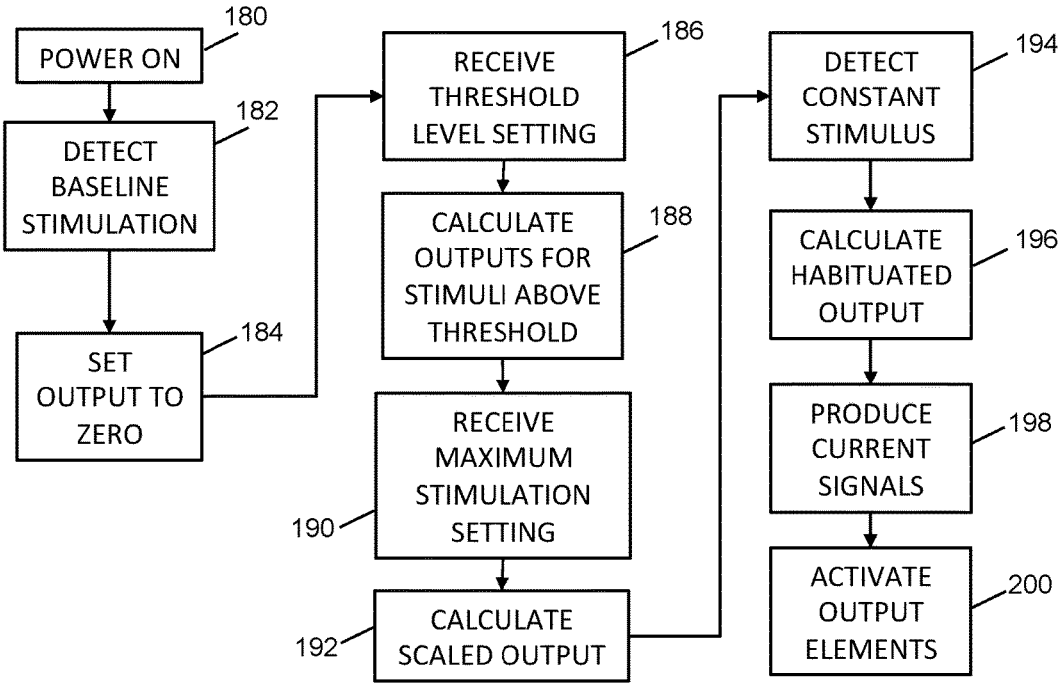
FIG. 11 is a flowchart of a further method that the penile presence simulation apparatus performs, according to an embodiment of the present invention.

Referring to FIG. 11, the processor may contain software and/or hardware designed to automatically normalize the behavior of the apparatus 50, 80, 100 or device 10 by measuring the baseline input from the sensors upon power-on, and setting the output of the output elements to zero at the measured level of baseline input from the sensors. This can account for sensor drift, inconsistency in sensor behavior over time, and/or other factors. In step 180, the apparatus or device is switched on. In step 182, the baseline stimulation on the prosthetic penile device is detected. In step 184, the output signal transmitted to the output elements is set to zero.

Still referring to FIG. 11, the processor may contain software and/or hardware designed to normalize the behavior of the system by establishing a threshold, which may be pre-programmed or user-controlled to filter out unwanted activation of the output elements, for example to prevent pressure from a condom placed over the prosthetic penile device from causing constant activation of the output elements. In step 186, the processor receives a threshold level setting. In step 188, the processor calculates output signals for only those stimuli that are above the threshold, otherwise the output signals are set to zero.

The output values may be scaled according to a maximum level of stimulation that is set by the wearer. In step 190, the processor receives a maximum value of the stimulation to be produced by the apparatus or device. In step 192, which is repeated throughout subsequent use of the device, the processor scales the output signal proportionally or otherwise in relation to the maximum setting.

The processor may contain software and/or hardware designed to mimic the behavior of human sensory nerves by varying the stimulation provided by the output elements so as to create a sensation that more closely matches the sensation experienced by stimulation of real biological parts of the body. For example, habituation may be simulated by the processor. Habituation is a behavior of the human nervous system whereby constant stimulation of a certain sensory nerve over a period of time causes a gradual diminishing in the perception of the stimulation of that nerve. This can be achieved by the processor continually or repeatedly measuring and recording activation of a sensor, and then gradually diminishing activation of the output element corresponding to that sensor if the input from the sensor does not vary. In step 194, the processor detects that there has been a constant stimulus on at least one sensor for a predetermined period of time. In step 196, the processor calculates the habituated output signal for the output element in question. Steps 194 and/or 196 may be repeated until the habituated output has been reduced to zero or a desired value, or until the stimulus changes. In step 198, the processor produces, or causes to be produced, output current signals for the output elements based on all the influencing factors, which may include on or more of baseline setting, threshold setting, maximum stimulus setting, habituation response and actual stimuli sensed. In step 200, the output elements are activated according to the output current signals.

D. Further Variations

While the present embodiments include the best presently contemplated mode of carrying out the subject matter disclosed and claimed herein, the invention may also be embodied in several other ways, with the ideal embodiment depending on the preferences of the wearer. Those skilled in the art will recognize that the embodiments as described herein do not cover the full scope of the invention as claimed.

For example, another possible embodiment might involve having the prosthetic penile device 52 separated by a great distance from the processor 56 and/or the output device 58, and with communication between the components by long-range radio waves, a wide area network, an Internet connection and associated servers and/or other known methods of long-distance communication. As another example, the output device 110 for use on the skin may be divided into multiple constituent output devices, or may be duplicated for stimulation in two locations simultaneously. The output device may be in the form of a band to be wrapped around a leg. Sensors and/or output elements may consist of multiple constituent sensors and/or output elements respectively. Sensors and/or output elements be grouped together. The distribution of the sensors and/or output elements may be random or semi-random, homogenous or inhomogeneous, or a combination of one or more of a regular array, a spatially varying array, a partially disordered array and a random arrangement. Voltage signals or digital signals may be used instead of current signals.

Throughout the description, specific details have been set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense. In general, unless otherwise indicated, singular elements may be in the plural and vice versa with no loss of generality.

The detailed description has been presented partly in terms of methods or processes, symbolic representations of operations, functionalities and features of the invention. These method descriptions and representations are the means used by those skilled in the art to most effectively convey the substance of their work to others skilled in the art. A software implemented method or process is here, and generally, understood to be a self-consistent sequence of steps leading to a desired result. These steps require physical manipulations of physical quantities. Often, but not necessarily, these quantities take the form of electrical or magnetic signals or values capable of being stored, transferred, combined, compared, and otherwise manipulated. It will be further appreciated that the line between hardware and software is not always sharp, it being understood by those skilled in the art that the software implemented processes described herein may be embodied in hardware, firmware, software, or any combination thereof. Such processes may be controlled by coded instructions such as microcode and/or by stored programming instructions in one or more tangible or non-transient media readable by a computer or processor. The code may be stored in any computer storage system or device, such as hard disk drives, optical drives, solid-state memories, etc. The methods may alternatively be embodied partly or wholly in specialized computer hardware, such as ASIC or FPGA circuitry.

Steps in the flowcharts may be performed in a different order, other steps may be added, or one or more may be removed without altering the main function of the device or apparatus. Steps may be repeated or duplicated. Steps in one flowchart may be combined with steps in the other flowchart. All parameters, materials, and configurations described herein are examples only and the actual choice of such depends on the specific embodiment. Accordingly, the scope of the invention is to be construed in accordance with the following claims.

The invention claimed is:

1. A prosthetic penile device, comprising:

a penis-shaped component to be worn by a wearer; and multiple sensors located on or in the penis-shaped component and configured to detect stimuli on the penis-shaped component;

wherein:

each said sensor is mapped to a different output element of an output device to be placed in non-penile bodily contact with the wearer, the output device being a pad separate from the penis-shaped component or an insert;

each said output element is activated in response to a stimulus detected by the sensor to which it is mapped; and each said output element stimulates a different location of the wearer.

2. The prosthetic penile device of claim 1, wherein each said sensor is arranged in an array.

3. The prosthetic penile device of claim 2, wherein at least some of said sensors are arranged in a denser array than others of said sensors, the denser array being located at an underside forward region of the penis-shaped component.

4. The prosthetic penile device of claim 1, wherein each said sensor is mapped to a single different one of said output elements.

5. The prosthetic penile device of claim 1, comprising the insert as a bulbous component in a unitary construction with the penis-shaped component.

6. The prosthetic penile device of claim 5, comprising a clitoral projection extending from the insert and having some of said output elements located thereon.

7. The prosthetic penile device of claim 6, wherein:

each said sensor is arranged in an array;

at least some of said sensors are arranged in a denser array than others of said sensors, the denser array being located at an underside forward region of the penis-shaped component; and the sensors in the denser array are mapped to the output elements on the clitoral projection.

8. The prosthetic penile device of claim 1, further comprising a processor for controlling said activation of the output elements in response to the stimuli on the penis-shaped component.

9. An apparatus for simulating presence of a penis, comprising:

a prosthetic penile device, comprising:

a penis-shaped component to be worn by a wearer; and multiple sensors located on or in the penis-shaped component and configured to detect stimuli on the penis-shaped component;

and an output device to be placed in non-penile bodily contact with the wearer, comprising multiple output elements, the output device being a pad separate from the penis-shaped component or an insert, wherein:

each said sensor is mapped to a different output element of the output device;

each said output element is activated in response to a stimulus detected by the sensor to which it is mapped; and each said output element stimulates a different location of the wearer.

10. The apparatus of claim 9, wherein the output device is the insert, the apparatus further comprising a harness to which the prosthetic penile device and insert are attached, wherein:

the prosthetic penile device is mounted at a front of the harness and oriented forward; and the insert is mounted at a base of the harness and oriented upward.

11. The apparatus of claim 9, wherein:

each said sensor is arranged in an array; and at least some of said sensors are arranged in a denser array than others of said sensors, the denser array being located at an underside forward region of the penis-shaped component.

12. The apparatus of claim 11, wherein:

the output device is the insert and is shaped as a vaginal insert having a clitoral wraparound;

the output elements are located on the vaginal insert and on the clitoral wraparound;

the sensors in the denser array are mapped to the output elements on the clitoral wraparound; and the remainder of the sensors are mapped to the output elements on the vaginal insert.

13. The apparatus of claim 9, wherein each said sensor is mapped to a single different one of said output elements.

14. The apparatus of claim 9, wherein:

the output device is the insert and comprises a bulbous component that is shaped for vaginal or anal insertion in the wearer; and some of the output elements are arranged in a greater density compared to others of the output elements.

15. The apparatus of claim 14, comprising a clitoral projection extending from the insert and having some of said output elements located thereon, wherein:

each said sensor is arranged in an array;

at least some of said sensors are arranged in a denser array than others of said sensors, the denser array being located at an underside forward region of the penis-shaped component; and the sensors in the denser array are mapped to the output elements on the clitoral projection.

16. The apparatus of claim 9, wherein the output device is the pad, for application to the wearer's skin.

17. The apparatus of claim 9, further comprising:

a processor for controlling said activation of the output elements in response to the stimuli on the penis-shaped component, wherein the processor communicates with the sensors and the output elements wirelessly or via wired connections.

18. The apparatus of claim 17, wherein the processor is part of a smartphone, personal computer, laptop, tablet or server.

19. The apparatus of claim 9, wherein:

each said sensor detects one or more of pressure, touch and temperature; and each output element stimulates the wearer using one or more of electricity, temperature and vibration.

20. A method for simulating presence of a penis, comprising:

wearing, by a wearer, a prosthetic penile device, comprising:

a penis-shaped component; and multiple sensors located on or in the penis-shaped component and configured to detect stimuli on the penis-shaped component; and wearing, by the wearer, in non-penile bodily contact, an output device comprising multiple output elements, the output device being a pad separate from the penis-shaped component or an insert, wherein:

each said sensor is mapped to a different output element of the output device;

each said output element is activated in response to a stimulus detected by the sensor to which it is mapped; and each said output element stimulates a different location of the wearer.

21. The method of claim 20, wherein the output device is worn inside a lower body cavity of the wearer or on a portion of skin of the wearer.

22. The method of claim 20, further comprising:

sensing, by one of the sensors, a stimulus on the penis-shaped component;

converting the sensed stimulus to an electrical signal;

calculating, by a processor, an output signal responsive to the electrical signal;

transmitting the output signal to the output element that is mapped to said one of the sensors; and activating the output element that is mapped to said one of the sensors to stimulate the wearer.

23. The method of claim 22, comprising:

sensing a greater concentration of stimuli on an underside forward region of the penis-shaped component than on a shaft of the penis-shaped component; and activating output elements that are located in a greater concentration at a more sensitive area of the wearer than at another area of the wearer;

wherein the sensors at said underside forward region are mapped to the output elements at the more sensitive area of the wearer.

24. The method of claim 22, wherein the stimulus sensed is one or more of pressure, touch and temperature.

25. The method of claim 22, comprising stimulating the wearer with one or more of electricity, temperature and vibration.

26. The method of claim 22, comprising stimulating the wearer:

more strongly when the sensed stimulus is correspondingly stronger; and less strongly when the sensed stimulus is correspondingly weaker.

27. The method of claim 22, comprising the processor:

receiving an input from the wearer of a maximum stimulus level; and modifying said calculation by scaling it according to said maximum stimulus level, such that said activating causes stimulation of the wearer without exceeding the maximum stimulus level.

28. The method of claim 22, comprising the processor:

detecting constant stimulation at one of the sensors for a period of time; and gradually reducing activation of the output element that is mapped to said one of the sensors.

29. The method of claim 22, comprising the processor:

measuring a baseline input from the sensors upon power-on of the prosthetic penile device and the output device; and setting said activation of the output elements to zero for the measured level of baseline input from the sensors.

30. The method of claim 22, comprising the processor:

receiving a threshold level of stimuli for the penis-shaped component; and activating the output elements only when the sensed stimuli exceed the threshold.

* * * * *